US008215752B2

(12) United States Patent
Morikoshi

(10) Patent No.: US 8,215,752 B2
(45) Date of Patent: Jul. 10, 2012

(54) LIQUID EJECTING HEAD AND LIQUID EJECTING APPARATUS

(75) Inventor: Koji Morikoshi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 280 days.

(21) Appl. No.: 12/642,476

(22) Filed: Dec. 18, 2009

(65) Prior Publication Data

US 2010/0165050 A1 Jul. 1, 2010

(30) Foreign Application Priority Data

Dec. 25, 2008 (JP) ..... 2008-330739

(51) Int. Cl.
*B41J 2/045* (2006.01)

(52) U.S. Cl. ..... 347/68

(58) Field of Classification Search ..... 347/50, 347/54, 56, 63, 65, 68
See application file for complete search history.

(56) References Cited

U.S. PATENT DOCUMENTS 6,803,090 B2 * 10/2004 Castiglione et al. ..... 428/172
6,813,831 B2 * 11/2004 Kamei et al. ..... 29/890.1
2010/0079546 A1 * 4/2010 Takahashi ..... 347/45

FOREIGN PATENT DOCUMENTS

JP 2004-042559 2/2004

* cited by examiner

*Primary Examiner* — An Do
(74) *Attorney, Agent, or Firm* — Workman Nydegger

(57) ABSTRACT

Provided is a liquid ejecting head including a plurality of substrates that are at least partially bonded to one another with adhesives and form a liquid passage in which a liquid flows. The liquid passage includes a pressure-generating chamber that communicates to a nozzle opening through which the liquid is ejected. The adhesive being exposed to a wall surface of the passage on the upstream side of the pressure-generating chamber is composed of a first adhesive, and the adhesive being exposed to a wall surface of the downstream-side passage including the pressure-generating chamber is composed of a second adhesive. The second adhesive has affinity with the liquid higher than that of the first adhesive.

5 Claims, 3 Drawing Sheets

LIQUID EJECTING HEAD AND LIQUID EJECTING APPARATUS

BACKGROUND

1. Technical Field

The present invention relates to a liquid ejecting head and a liquid ejecting apparatus.

2. Related Art

Some of ink jet type recording heads, which are one type of liquid ejecting heads, each include an actuator unit and a passage unit. The actuator unit is provided with piezoelectric elements and pressure-generating chambers. The passage unit includes a nozzle plate provided with nozzle openings communicating to the pressure-generating chambers and discharging ink droplets, and includes a reservoir-forming substrate provided with a reservoir serving as an ink chamber that is common to the pressure-generating chambers (for example, see pages 6 to 8 and FIGS. 1 and 2 in JP-A-2004-042559).

In such an ink jet type recording head, bubbles that occur or flow in liquid passages (in particular, the pressure-generating chambers) cause printing defects. Therefore, a maintenance action includes a cleaning step for eliminating bubbles. However, since the bubbles are not completely eliminated by the cleaning, there occurs a problem in which the printing characteristics are prevented from recovering due to the remaining bubbles. In particular, bubbles in the pressure-generating chambers are required to be surely eliminated. However, since the adhesive bonding substrates and being exposed to side walls of the pressure-generating chambers is low in affinity with ink, bubbles are apt to adhere to the adhesive, and cleaning at a low flow rate cannot readily eliminate the adhering bubbles.

In order to solve the above-mentioned problem, it is conceivable to use an acrylic resin-based adhesive having high affinity with ink. But the adhesive property of the acrylic resin-based adhesive is too low to be used for constituting an ink jet type recording head. It is also conceivable to increase the affinity of ink itself, but ink has a problem in which the flexibility in design is low.

Furthermore, these problems are present not only in ink jet type recording heads but also in liquid ejecting heads ejecting liquids other than ink.

SUMMARY

An advantage of some aspects of the invention is to provide a liquid ejecting head and a liquid ejecting apparatus that are improved in bubble-eliminating properties.

A liquid ejecting head of the present invention includes a plurality of substrates that are partially bonded to one another with adhesives and form a liquid passage in which a liquid flows. The liquid passage includes a pressure-generating chamber that communicates to a nozzle opening through which the liquid is ejected. The adhesive being exposed to a wall surface of the passage on the upstream side of the pressure-generating chamber is composed of a first adhesive, and the adhesive being exposed to a wall surface of the downstream-side passage including the pressure-generating chamber is composed of a second adhesive. The affinity of the second adhesive with the liquid is higher than that of the first adhesive.

In the invention, the region on the upstream side of the pressure-generating chamber is constituted such that the first adhesive having low affinity with a liquid continuously adsorbs bubbles to aggregate the bubbles and make the size of the bubbles larger and that thereby the bubbles can be eliminated even by low-flow-rate cleaning. At the same time, by adsorbing bubbles with the first adhesive having low affinity with a liquid on the upstream side of the pressure-generating chamber, the bubbles are inhibited from flowing into the pressure-generating chamber during the liquid discharging process, resulting in that a reduction in discharge characteristics is prevented. In addition, since the adhesive being exposed to the wall surface of the downstream-side passage including the pressure-generating chamber is composed of the second adhesive having affinity higher than that of the first adhesive, bubbles are not adsorbed to the adhesive in the pressure-generating chamber and can be therefore eliminated even by low-flow-rate cleaning.

A liquid ejecting head of the invention includes a plurality of substrates that are partially bonded to one another and form a liquid passage in which a liquid flows. The liquid passage includes a pressure-generating chamber that communicates to a nozzle opening through which the liquid is ejected. The adhesive being exposed to a wall surface of the passage on the upstream side of the pressure-generating chamber is composed of a first adhesive having a contact angle with pure water of 90 degrees or larger, and the adhesive being exposed to a wall surface of the downstream-side passage including the pressure-generating chamber is composed of a second adhesive having a contact angle with pure water of 80 degrees or less.

Bubbles readily adhere to an adhesive having a contact angle with pure water of 90 degrees or larger, and bubbles hardly adhere to an adhesive having a contact angle with pure water of 80 degrees or less. That is, in the invention, the region on the upstream side of the pressure-generating chamber is constituted such that bubbles can be eliminated even by low-flow-rate cleaning by continuously adsorbing bubbles with the first adhesive, which has a contact angle with pure water of 90 degrees or larger and to which bubbles readily adhere, to aggregate the bubbles and make the size of the bubbles larger. At the same time, bubbles are inhibited from flowing into the pressure-generating chamber during the liquid discharging process by adsorbing the bubbles with the first adhesive, to which bubbles readily adhere, on the upstream side of the pressure-generating chamber, resulting in that a reduction in discharge characteristics is prevented. In addition, since the adhesive layer being exposed to the wall surface of the downstream-side passage including the pressure-generating chamber is composed of the second adhesive having a contact angle with pure water of 80 degrees or less and to which bubbles hardly adhere, bubbles are not adsorbed to the adhesive in the pressure-generating chamber. Therefore, the bubbles can be eliminated even by low-flow-rate cleaning.

The liquid passage includes a reservoir that communicates to a plurality of the pressure-generating chambers on one wall surface side thereof and serves as a common liquid chamber. The adhesive being exposed to the one wall surface is preferably composed of the second adhesive. By using the second adhesive as the adhesive that is exposed to the side face, among the side faces in the longitudinal direction of the reservoir, near the pressure-generating chamber, bubbles can be more readily eliminated by cleaning. In addition, bubbles that have been adsorbed are inhibited from flowing into the pressure-generating chambers, resulting in that a reduction in discharge characteristics is prevented.

Specifically, it is preferable that the first adhesive be made of a thermoplastic resin and that the second adhesive be made of a thermoplastic resin containing 0.1 to 5.0 wt % of an additive that imparts affinity with the liquid to the second adhesive. By using these adhesives, the above-described constitution can be readily realized, and the bubble-eliminating characteristics of the liquid ejecting head can be improved.

The liquid ejecting apparatus of the invention includes any of the liquid ejecting heads. By including the liquid ejecting head, the liquid ejecting apparatus can have excellent bubble-eliminating characteristics and improved discharge characteristics.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail below through embodiments.

Figure 1:
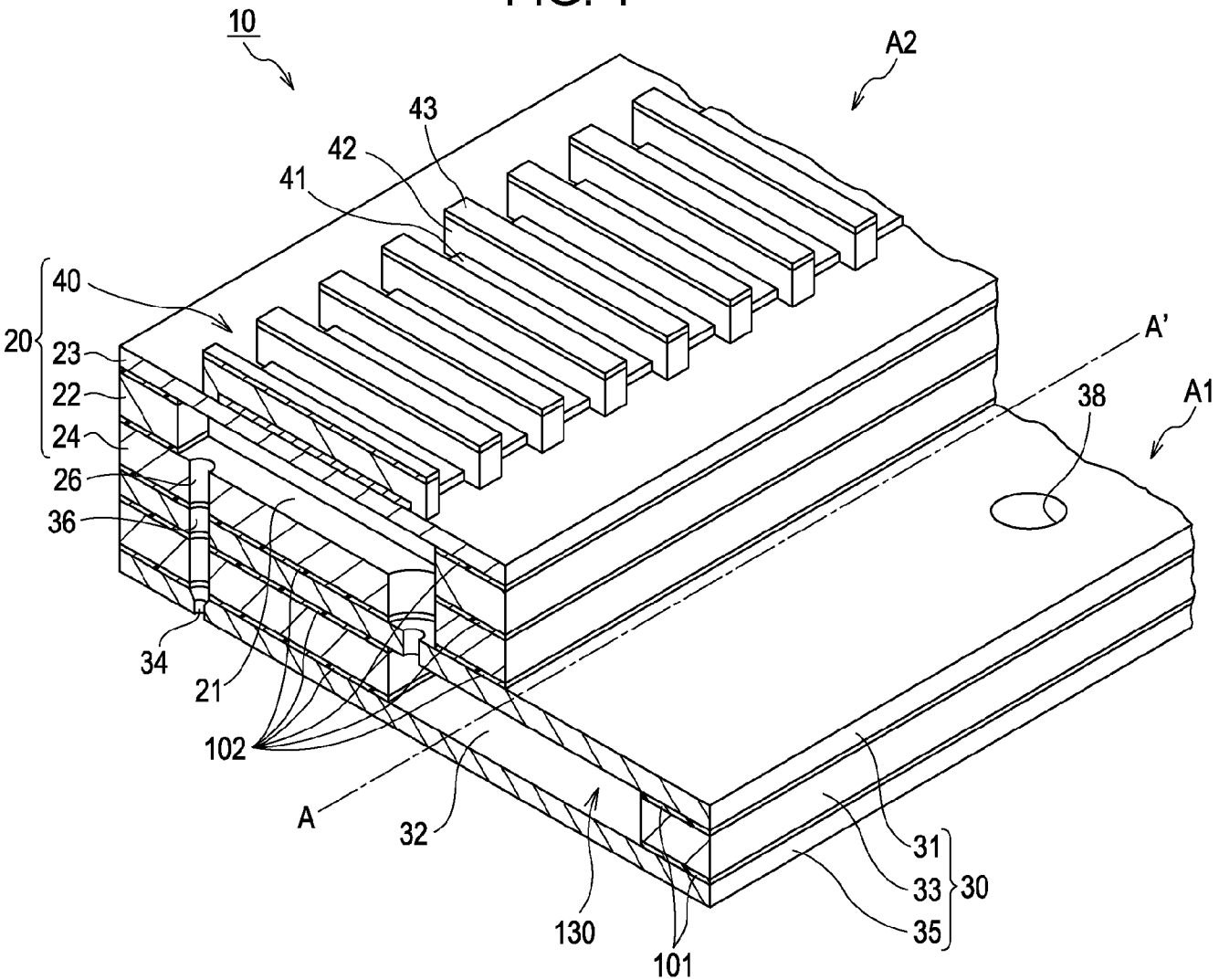
FIG. 1 is a cut-out perspective view of the main portion of a recording head according to Embodiment 1 of the invention.
Figure 2:
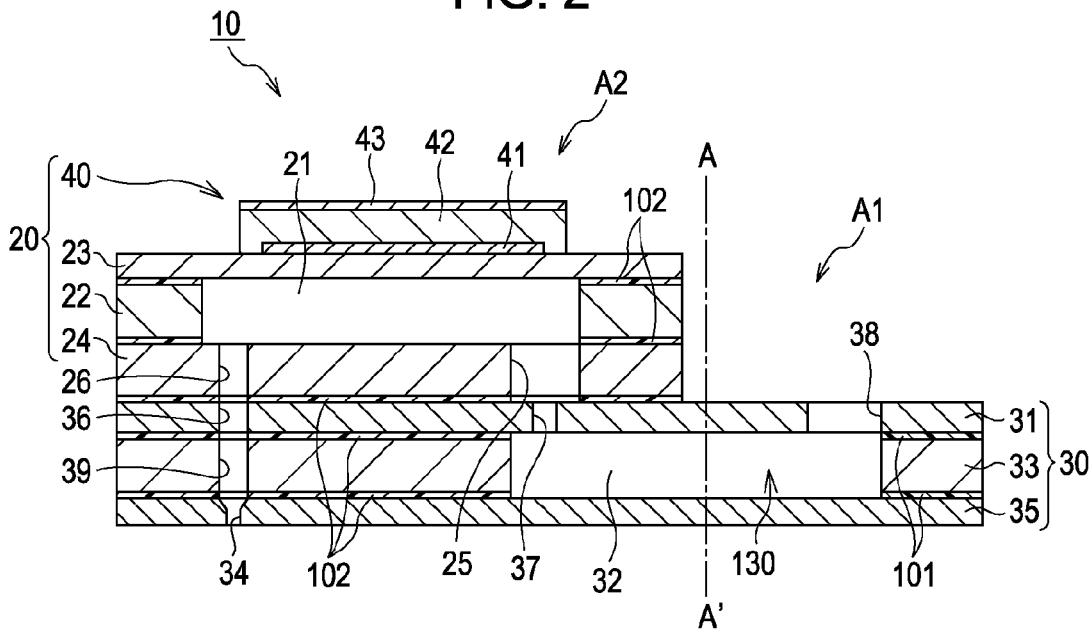
FIG. 2 is a cross-sectional view of the recording head according to Embodiment 1 of the invention.
Figure 3:
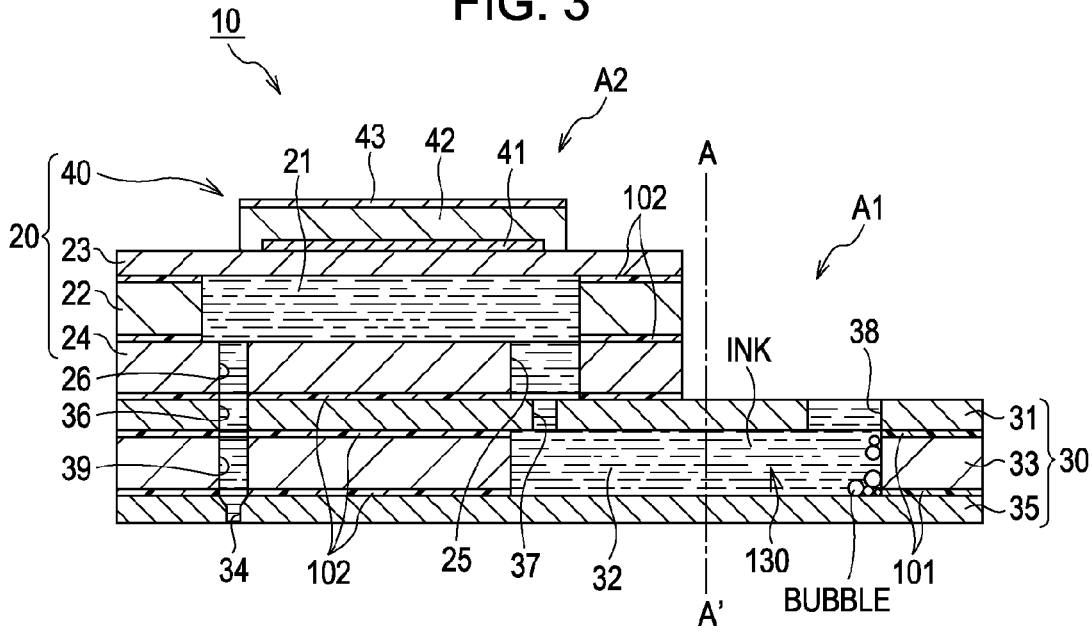
FIG. 3 is a cross-sectional view of the recording head according to Embodiment 1 of the invention.

FIG. 1 is a cut-out perspective view of the main portion of an ink jet type recording head showing an example of the liquid ejecting head according to Embodiment 1 of the invention. FIGS. 2 and 3 are cross-sectional views of the ink jet type recording head.

As shown in the drawings, the ink jet type recording head 10 of the Embodiment is constituted of an actuator unit 20 and a passage unit 30 to which the actuator unit 20 is fixed.

The actuator unit 20 is an actuator apparatus having piezoelectric elements 40 and includes a passage-forming substrate 22 provided with pressure-generating chambers 21, a vibration plate 23 disposed on one side of the passage-forming substrate 22, and a pressure-generating chamber baseplate 24 disposed on the other side of the passage-forming substrate 22.

The passage-forming substrate 22 is, for example, a plate having a thickness of about 150 μm and made of a ceramic material such as alumina ($Al_2O_3$) or zirconia ($ZrO_2$). In the Embodiment, a plurality of the pressure-generating chambers 21 are arranged along the width direction of the passage-forming substrate 22. The vibration plate 23 made of, for example, a stainless steel (SUS) thin plate with a thickness of 10 to 12 μm is fixed to the passage-forming substrate 22 so as to seal one side of each pressure-generating chamber 21.

The pressure-generating chamber baseplate 24 is fixed to the passage-forming substrate 22 on the other side so as to seal the other side of each pressure-generating chamber 21. In addition, the pressure-generating chamber baseplate 24 has supply communication pores 25 that are provided near the ends of the pressure-generating chambers 21 at one side in the longitudinal direction and communicate the pressure-generating chambers 21, and has a reservoir described below and nozzle communication pores 26 that are provided near the ends of the pressure-generating chambers 21 at the other side in the longitudinal direction and communicate to nozzle openings 34 described below.

Furthermore, the piezoelectric elements 40 are disposed on the vibration plate 23 so as to oppose the corresponding pressure-generating chambers 21 with the vibration plate 23 therebetween.

The piezoelectric elements 40 are constituted of a lower electrode film 41 disposed on the vibration plate 23, piezoelectric material layers 42 that are independently provided for the respective pressure-generating chambers 21, and an upper electrode film 43 disposed on the piezoelectric material layers 42. The piezoelectric material layer 42 is formed by applying a green sheet made of a piezoelectric material or printing the material. The lower electrode film 41 is disposed over all the piezoelectric material layers 42 arranged side by side and serves as a common electrode of the piezoelectric elements 40 and also functions as a part of the vibration plate. The lower electrode film 41 may be disposed for each of the piezoelectric material layers 42.

The passage-forming substrate 22, the vibration plate 23, and the pressure-generating chamber baseplate 24 of the actuator unit 20 are each made of a substrate of, for example, stainless steel (SUS) and are bonded to one another with an adhesive. Then, the piezoelectric elements 40 are disposed on the vibration plate 23.

The passage unit 30 is composed of a liquid-supplying orifice-forming substrate 31 that is bonded to the pressure-generating chamber baseplate 24 of the actuator unit 20, a reservoir-forming substrate 33 that forms a reservoir 32 serving as a common ink chamber of a plurality of the pressure-generating chambers 21, and a nozzle plate 35 provided with nozzle openings 34.

The liquid-supplying orifice-forming substrate 31 is made of a stainless steel (SUS) thin plate with a thickness of 60 μm and is provided with nozzle communication pores 36, liquid-supplying orifices 37, and a liquid-introducing pore 38. The nozzle communication pores 36 communicate the nozzle openings 34 and the pressure-generating chambers 21. The liquid-supplying orifices 37, together with the supply communication pores 25, connect the reservoir 32 and the pressure-generating chambers 21. The liquid-introducing pore 38 communicates to the reservoir 32 and supplies ink from an external ink tank thereto. The liquid-supplying orifices 37 are provided at one end of the reservoir 32, which is described below, in the lateral direction, and the liquid-introducing pore 38 is provided at the other end of the reservoir 32 so that the liquid-supplying orifices 37 and the liquid-introducing pore 38 communicate to each other via the reservoir 32. In the Embodiment, one liquid-introducing pore 38 is provided so as to communicate to the reservoir 32, which is described in detail below, at the central portion of the reservoir 32 in the longitudinal direction in which the pressure-generating chambers 21 are arranged side by side.

The reservoir-forming substrate 33 is a plate having corrosion resistance, such as a stainless steel plate with a 150 μm thickness, suitable for constituting an ink passage (liquid passage) and has the reservoir 32 for receiving ink from the external ink tank (not shown) and supplying the ink to the pressure-generating chambers 21 and has nozzle communication pores 39 communicating the pressure-generating chambers 21 and the nozzle openings 34.

The reservoir 32 is provided so as to extend over a plurality of the pressure-generating chambers 21, that is, over the direction in which the pressure-generating chambers 21 are arranged side by side. Accordingly, the longitudinal direction of the reservoir 32 corresponds to the arrangement direction of the pressure-generating chambers 21. The reservoir 32 supplies ink introduced through the liquid-introducing pore 38 to the pressure-generating chambers 21 through the supply communication pores 25. As the material for the reservoir-forming substrate 33, metals such as stainless steel and ceramic can be used.

The nozzle plate 35 is, for example, a stainless steel thin plate provided with the nozzle openings 34 that are perforated in the same pitches as those of the pressure-generating chambers 21.

The substrates constituting the passage unit 30 and the actuator unit 20, that is, the passage-forming substrate 22, the vibration plate 23, the pressure-generating chamber baseplate 24, the liquid-supplying orifice-forming substrate 31, the reservoir-forming substrate 33, and the nozzle plate 35, are fixed to one another with adhesives.

The adhesives will now be described. In the Embodiment, each substrate is bonded with a first adhesive 101 and a second adhesive 102. Specifically, in the region A1, which is on the liquid-introducing pore 38 side of the line A-A' in FIGS. 1 and 2, each substrate is bonded with the first adhesive 101, and in the region A2, which is on the actuator unit 20 side of the line A-A', each substrate is bonded with the second adhesive 102. That is, in the ink jet type recording head 10, two types of adhesives are used for bonding.

In the case in which the substrates are thus bonded, as shown in FIG. 2, in the wall surface constituting the liquid passage from the liquid-introducing pore 38 to the nozzle openings 34, the first adhesive 101 is exposed to the wall surface from the liquid-introducing pore 38 to the upstream side of the reservoir 32, and the second adhesive 102 is exposed to the wall surface from the downstream side of the reservoir 32 to the nozzle openings 34.

The first adhesive 101 is low in affinity with the ink (liquid) flowing in the passage (that is, having lyophobicity), and the second adhesive 102 has higher affinity with the ink than the first adhesive 101 (that is, has a lyophilicity). As shown in FIG. 3, bubbles in ink are adsorbed to the first adhesive 101 being exposed to the wall surface because the first adhesive 101 has the lyophobicity. The adsorbed bubbles aggregate to grow in size and are thereby eliminated easily even by low-flow-rate cleaning. In addition, the adsorption of bubbles to the first adhesive 101 being exposed to the wall surface inhibits the bubbles from flowing into the pressure-generating chamber 21 during the liquid discharging process, resulting in that a reduction in discharge characteristics is prevented. Furthermore, since the second adhesive 102 has the lyophilicity, even if the bubbles not adsorbed to the first adhesive 101 flow into the pressure-generating chamber 21, the bubbles are not adsorbed to the second adhesive 102. Therefore, the bubbles can be eliminated by cleaning as a maintenance action. Furthermore, in this case, as shown by the Embodiment, since the adhesive being exposed to the side face on the liquid-supplying orifice 37 side (upstream side) of the reservoir 32 is the second adhesive 102, bubbles are hardly adsorbed, and the ink is not prevented from flowing into the pressure-generating chambers 21. In addition, the constitution prevents bubbles having large sizes from flowing into the pressure-generating chambers 21. Therefore, the ink-discharging characteristics are improved.

In the Embodiment, bubbles can be thus eliminated by cleaning. As a result, defective discharge due to bubbles can be reduced. In addition, since bubbles are prevented from flowing into the pressure-generating chambers 21, a reduction in the discharge characteristics can be prevented. The first adhesive 101 and the second adhesive 102 will be described in detail below.

Regarding the affinity of these adhesives with, for example, a liquid having a surface tension of 20 to 30 mN/m (for example, ink used in an ink jet type recording head), the first adhesive 101 has a contact angle with pure water of 90 degrees or larger, and the second adhesive 102 has a contact angle with pure water of 80 degrees or less. When the contact angle of the first adhesive 101 with pure water is 90 degrees or larger, the affinity with the above-mentioned liquid is sufficiently low, and thereby bubbles are sufficiently adsorbed. On the other hand, since the static contact angle of pure water on SUS (stainless steel) used as a head-constituting member is 70 to 80 degrees, the second adhesive 102 having a contact angle with pure water of 80 degrees or less has high hydrophilicity similar to that of the constitutional member. Consequently, bubbles are hardly adsorbed.

As the first adhesive 101, a thermoplastic resin having a contact angle with pure water of 90 degrees or larger, that is, a lyophobic thermoplastic resin, can be used. Specific examples of the resin include polyolefin-based resins excellent in adhesion of metals. The polyolefin-based resins include polyolefin resins and ethylene-based polymers. Examples of the polyolefin resins include polypropylene, polybudene, polymethylpentene, polystyrene, polyester, polyamide, and polyethylene. These may be used alone or in a combination of two or more. Examples of the ethylene-based polymers include an ethylene/α-olefin copolymer, an ethylene/vinyl acetate copolymer (EVA), an ethylene/(meth) acrylic acid copolymer, and an ethylene/(meth)acrylate copolymer. These may be used alone or in a combination of two or more. Furthermore, a combination of the polyolefin resin and the ethylene-based polymer may be used. Preferably, Admer VE 300 (EVA base) manufactured by Mitsui Chemical Company is used.

As the second adhesive 102, a thermoplastic resin having a contact angle with pure water of 80 degrees or less, that is, a lyophilic thermoplastic resin, can be used. Specifically, the second adhesive 102 is composed of a base material, which may be the above-mentioned polyolefin-based resin excellent in adhesion of metals, and an additive for imparting lyophilicity to the polyolefin-based resin (preferably, a polyolefin resin or an ethylene-based polymer) serving as the base material. Examples of the additive include those having hydrophilic groups, such as surfactants, antistatic agents, and antifog additives. These may be used alone or in a combination of two or more. The additive contained in the adhesive resin is thermally fused and bleeds to the surface (bleeding) when the substrates are bonded to one another, and the hydrophilic functional group in the bled additive can increase the degree of hydrophilicity of the surface of the second adhesive 102. The hydrophilic portion of the surfactant may be ionic (cationic, anionic, or amphoteric) or nonionic. In particular, nonionic surfactants and anionic surfactants are hardly affected by ionic materials contained in ink and, therefore, do not generate foreign substances in the head (in the ink passage) by a reaction with the ink. Therefore, the nonionic surfactants and the anionic surfactants are preferred as the additive for ink jetting.

Examples of the nonionic surfactants include polyoxyethylene alkyl ether, polyoxyethylene alkyl amine, glycerin fatty acid ester, polyglycerin fatty acid ester, polyoxyethylene alkyl amide, sorbitan, propylene glycol, polypropylene glycol, fatty acid sorbitan ester, and alkyl monoglyceryl ether. These may be used alone or in a combination of two or more. Examples of the anionic surfactants include alkylsulfonic acid salts and alkylbenzenesulfonic acid salts. These may be used alone or in a combination of two or more. Furthermore, a combination of the nonionic surfactant and the anionic surfactant may be used.

Specifically, in the Embodiment, particularly preferred additives are, for example, irugasurfhl560 (HLB value: about 13 to 19), manufactured by Chiba Speciality Chemicals, whose main component is a master batch mixture of polyoxyethylene alkyl ether and polypropylene and Atmer129V (HLB value: about 5 to 8), manufactured by Chiba Speciality Chemicals, whose main component is glycerin fatty acid ester.

The additive is added to the resin at a ratio of 0.1 to 5.0 wt %, preferably 0.25 to 5.0 wt %. Within this range, the above-described hydrophilicity can be obtained, and the adhesive can have sufficient adhesive strength. The ratio of the additive is more preferably 0.5 to 5.0 wt %, and most preferably 1.0 wt %.

Furthermore, the first adhesive 101 and the second adhesive 102 may contain other additives within a range that does not impair the adhesive properties and lyophilicity (or lyophobicity).

Such adhesives have sufficient adhesion properties by being applied to a substrate or by being formed into a film, placed on a substrate, and then being heated and pressed. In the Embodiment, from the standpoint of convenience of handling, the adhesive is used in a form of a thermal adhesive film. In this case, since the first adhesive 101 and the second adhesive 102 of the Embodiment have higher adhesive properties than acrylic adhesives, the ink jet type recording head 10 can be constituted.

In the above-constituted ink jet type recording head 10, ink is introduced into the reservoir 32 from an ink cartridge through the liquid-introducing pore 38, and the ink passage from the reservoir 32 to the nozzle openings 34 is filled with the ink. Then, according to a recording signal from a driving circuit (not shown), a voltage is applied to a piezoelectric element 40 corresponding to each of the pressure-generating chambers 21 to deform both the piezoelectric element 40 and the vibration plate 23. As a result, the pressure in the pressure-generating chamber 21 is increased, and thereby ink droplets are ejected through the corresponding nozzle opening 34. That is, the ink passage (liquid passage) refers to the passage, in which ink flows, from the liquid-introducing pore 38 to the nozzle opening 34, via the reservoir 32, the liquid-supplying orifice 37, the supply communication pore 25, the pressure-generating chamber 21, and nozzle communication pores 26, 36, and 39. The passage may further have, for example, an additional communication pore or may not have any of the pores or the like, according to the constitution of the ink jet type recording head 10. Incidentally, the passage on the upstream side of the pressure-generating chambers 21 refers to the passage from the pressure-generating chamber 21 to the liquid-introducing pore 38, and the downstream-side passage including the pressure-generating chamber 21 refers to the passage from the pressure-generating chamber 21 to the nozzle opening 34. In this case, as described above, by using the first adhesive 101 and the second adhesive 102, bubbles are adsorbed to the first adhesive 101 and thereby hardly flow in the pressure-generating chambers 21.

Example 1

Ink jet type recording heads were constituted using Admer VE 300 manufactured by Mitsui Chemical Company, as the first adhesive 101, and a mixture prepared by adding iruga-surfhl560 (additive 1) manufactured by Chiba Speciality Chemicals to Admer VE 300 manufactured by Mitsui Chemical Company, as the second adhesive 102. In this case, the amounts of the additive 1 in the second adhesive 102 were 0, 0.1, 0.25, 0.5, 1.0, 2.0, 5.0, and 10 wt %, and the contact angle of the second adhesive 102 with pure water was measured at each of the amounts with FTA4000 (a contact angle goniometer manufactured by FTA).

The results showed that when the additive 1 was not added (that is, when the composition of the second adhesive 102 was the same as that of the first adhesive 101), the contact angle with pure water was 90 degrees or larger and the bubble-eliminating property of the constituted ink jet type recording head was low. It is presumed that this was caused by that no lyophilic adhesive was present on the downstream side of the pressure-generating chambers.

When the amounts of the additive 1 were 0.1 and 0.25 wt %, the contact angles with pure water were about 80 degrees or less and the bubble-eliminating properties of the ink jet type recording heads were higher than that in the case in which the additive 1 was not used. When the amounts of the additive 1 were 0.5, 1.0, 2.0, and 5.0 wt %, the contact angles with pure water were about 80 degrees or less and the bubble-eliminating properties of the ink jet type recording heads were the highest. Thus, the bubble-eliminating property was improved by constituting the ink jet type recording head using the first adhesive 101 and the second adhesive 102.

Furthermore, an ink jet type recording head was constituted as in above using Atmer129V (additive 2), manufactured by Chiba Speciality Chemicals, instead of the additive 1. In this case, the amount of the additive 2 was 2.0 wt %, and the contact angle of the second adhesive 102 with pure water was measured with FTA4000 (a contact angle goniometer manufactured by FTA). The results showed that the contact angle with pure water was 75 degrees or less and the bubble-eliminating property of the ink jet type recording head was further increased. Thus, the bubble-eliminating property was improved by constituting the ink jet type recording head using the first adhesive 101 and the second adhesive 102.

Figure 4:
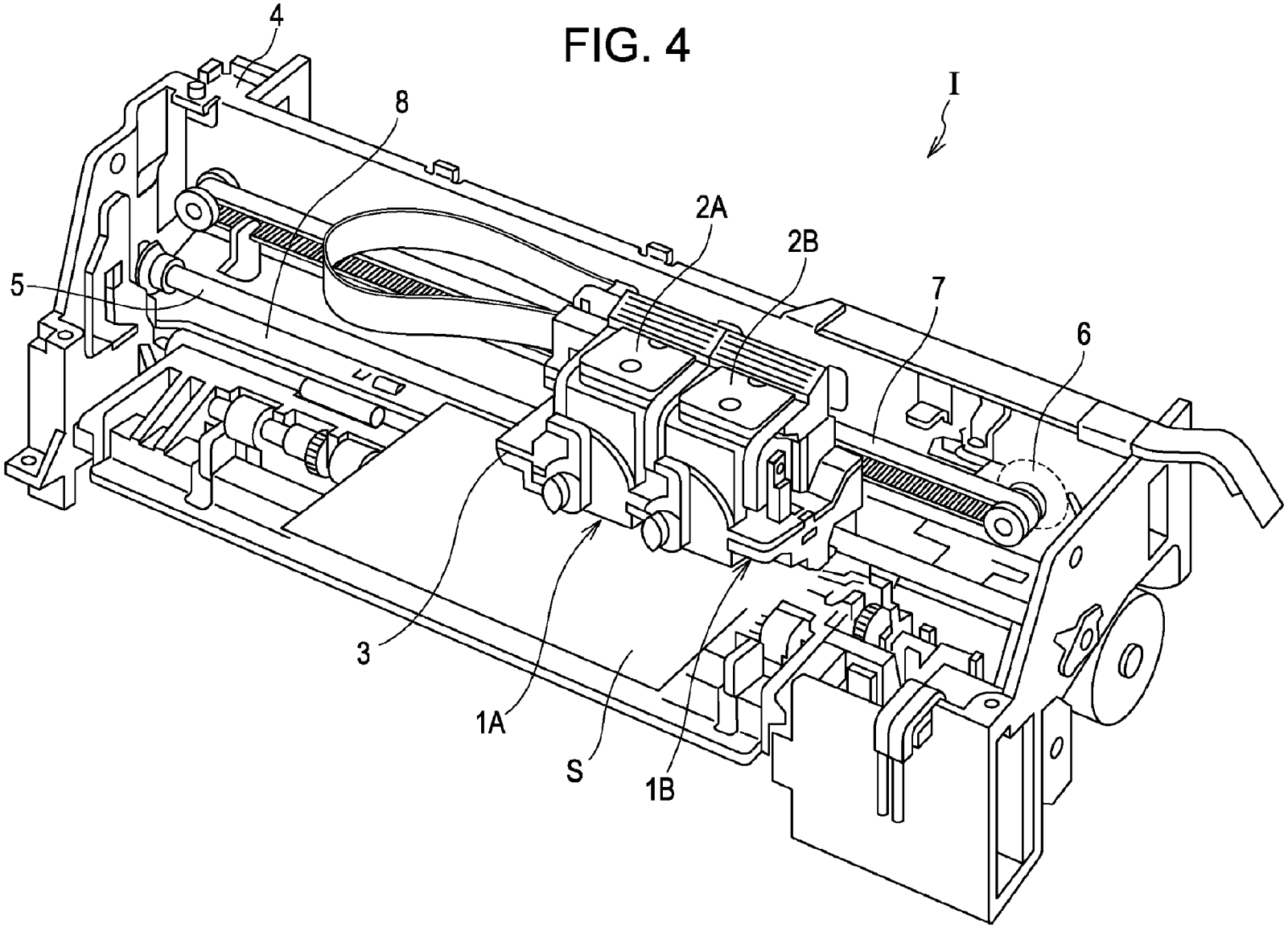
FIG. 4 is a schematic view of an ink jet type recording apparatus according to an embodiment of the invention.

Next, an ink jet type recording apparatus (liquid ejecting apparatus) having the ink jet type recording head 10 of the Embodiment will be described. The ink jet type recording head 10 of the Embodiment constitutes a part of a recording head unit having an ink passage that communicates to an ink cartridge or the like. The ink jet type recording head 10 is mounted on an ink jet type recording apparatus I. FIG. 4 is a schematic view of an example of the ink jet type recording apparatus.

As shown in FIG. 4, recording head units 1A and 1B having ink jet type recording heads are detachably provided with cartridges 2A and 2B constituting ink supplying means. A carriage 3 on which the recording head units 1A and 1B are mounted is set to a carriage shaft 5 fit in the apparatus body 4 in the manner that the carriage 3 can move in the axis direction of the carriage shaft 5. The recording head units 1A and 1B discharge, for example, a black ink composition and a color ink composition, respectively.

Furthermore, the driving force of a driving motor 6 is transmitted to the carriage 3 via a plurality of gears (not shown) and a timing belt 7, and thereby the carriage 3 on which the recording head units 1A and 1B are mounted moves along the carriage shaft 5. In addition, the apparatus body 4 is provided with a platen 8 along the carriage shaft 5 so that a recording sheet S, which is a recording medium, such as paper, fed by a paper-feeding roller (not shown) or the like, is supported by the platen 8 to be transferred.

In the above-described Embodiment, the actuator unit 20 is also constituted by bonding with an adhesive. However, each layer of the actuator unit 20, namely, the passage-forming substrate 22, the vibration plate 23, and the pressure-generating chamber baseplate 24, may be integrally formed, without using the adhesive, by shaping clay ceramic materials, so-called green sheets, so as to have predetermined thicknesses, perforating the sheets for forming pressure-generating chambers 21 and other portions, and burning a laminate of the green sheets. In such a case, only the passage unit 30 side is required to be bonded with the first adhesive 101 and the second adhesive 102. Bubbles in ink are adsorbed at least by the first adhesive 101 on the upstream side of the pressure-generating chambers 21 and are therefore prevented from flowing into the pressure-generating chambers 21. At the same time, the ink-discharging characteristics are improved by the second adhesive 102 being exposed to the side wall on the pressure-generating chamber 21 side.

In the above-described Embodiment, an ink jet type recording head 10 having thick film-type piezoelectric elements 40 is exemplified, but the pressure-generating means for varying the pressure in the pressure-generating chambers 21 is not limited thereto. The same effect can be obtained by an ink jet type recording head having, for example, a thin film-type piezoelectric element including a piezoelectric material formed by a sol-gel method, an MOD method, sputtering, or the like, a longitudinal vibration-type piezoelectric element in which a piezoelectric material and an electrode-forming material are alternately laminated and are expanded and contracted in the axis direction, a so-called electrostatic actuator in which a vibration plate and an electrode are arranged with a predetermined distance to control the vibration of the vibration plate by electrostatic force, or a pressure-generating chamber provided with a heat-generating element for discharging liquid droplets through a nozzle opening using bubbles generated by heat of the heat-generating element.

Furthermore, in the above-described Embodiment, the reservoir 32 of the ink jet type recording head is constituted by the reservoir-forming substrate 33 alone, but may be constituted by a plurality of reservoir-forming substrates. In addition, a compliance substrate may be disposed between the reservoir-forming substrate 33 and the nozzle plate 35 for providing a compliance portion below the reservoir 32.

In the above-described Embodiment, an ink jet type recording head has been described as an example of the liquid ejecting head, but the invention can be widely applied to general liquid ejecting heads and also can be certainly applied to an examination method of a liquid ejecting head that ejects a liquid other than ink. Examples of the other liquid ejecting head include various types of recording heads used in image-recording apparatuses such as printers, color material-ejecting heads used in manufacturing of color filters of liquid crystal displays and so on, electrode material ejecting heads used in formation of electrodes of organic EL displays, field emission displays (FEDs) and so on, and bioorganic material ejecting heads used in manufacturing of bio chips.

What is claimed is:

1. A liquid ejecting head comprising a plurality of substrates that are at least partially bonded to one another with adhesives and form a liquid passage in which a liquid flows, wherein the liquid passage includes a pressure-generating chamber that communicates to a nozzle opening through which the liquid is ejected;

the adhesive being exposed to a wall surface of the passage on the upstream side of the pressure-generating chamber is composed of a first adhesive;

the adhesive being exposed to a wall surface of the downstream-side passage including the pressure-generating chamber is composed of a second adhesive; and the second adhesive has affinity with the liquid higher than that of the first adhesive.

2. The liquid ejecting head according to claim 1, wherein the liquid passage includes a reservoir that communicates to a plurality of the pressure-generating chambers on one wall surface side of the reservoir and serves as a common liquid chamber; and the adhesive being exposed to the one wall surface is composed of the second adhesive.

3. The liquid ejecting head according to claim 1, wherein the first adhesive is composed of a thermoplastic resin; the second adhesive is composed of a thermoplastic resin containing 0.1 to 5.0 wt % of an additive that imparts affinity with the liquid to the second adhesive.

4. A liquid ejecting apparatus comprising the liquid ejecting head according to claim 1.

5. A liquid ejecting head comprising a plurality of substrates that are at least partially bonded to one another and form a liquid passage in which a liquid flows, wherein the liquid passage includes a pressure-generating chamber that communicates to a nozzle opening through which the liquid is ejected; the adhesive being exposed to a wall surface of the passage on the upstream side of the pressure-generating chamber is composed of a first adhesive having a contact angle with pure water of 90 degrees or larger; and the adhesive being exposed to a wall surface of the downstream-side passage including the pressure-generating chamber is composed of a second adhesive having a contact angle with pure water of 80 degrees or less.

* * * * *